United States Patent [19]

Hunter

[11] Patent Number: 4,830,253

[45] Date of Patent: May 16, 1989

[54] METHOD AND APPARATUS FOR AUXILIARY USE OF NAILING GUN

[76] Inventor: James L. Hunter, P.O. Box 7023, Incline Village, Nev. 89450

[21] Appl. No.: 449,175

[22] Filed: Dec. 13, 1982

[51] Int. Cl.[4] ..... B25C 1/04

[52] U.S. Cl. ..... 227/8; 227/430; 83/574

[58] Field of Search ..... 227/8, 130, 156; 30/124; 83/574; 74/480, 501

[56] References Cited

U.S. PATENT DOCUMENTS 4,197,974 4/1980 Morton ..... 227/8
4,222,285 9/1980 Kine ..... 74/480 R
4,351,209 9/1982 Alford ..... 83/574
4,359,822 11/1982 Kolodziejczyk ..... 30/122 X

*Primary Examiner*—Paul A. Bell
*Attorney, Agent, or Firm*—Herbert C. Schulze

[57] ABSTRACT

This is a method and apparatus whereby a nailing gun, designed primarily for vertical nailing, may be used safely and conveniently for horizontal nailing by the utilization of an auxiliary safety trigger, for the nailing gun, so located at a distance from the normal safety trigger, that an operator can utilize the nailing gun for horizontal nailing wherein the gun is held at a position of balance for such horizontal nailing, which position of balance, results in the least effort being required to handle the gun.

5 Claims, 3 Drawing Sheets

FIG. 3.
PRIOR ART
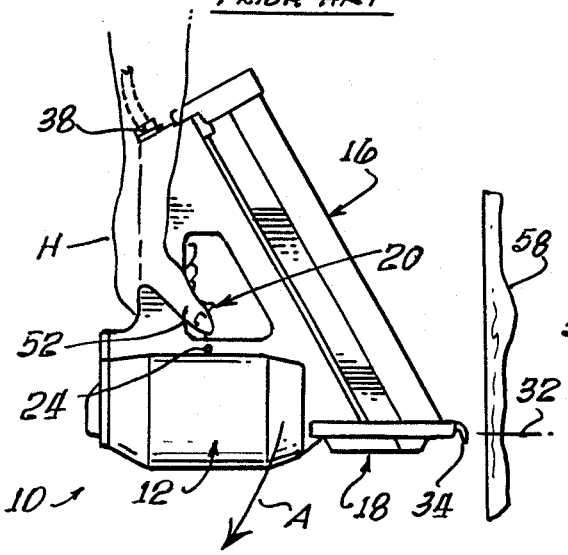
FIG. 4.
PRIOR ART
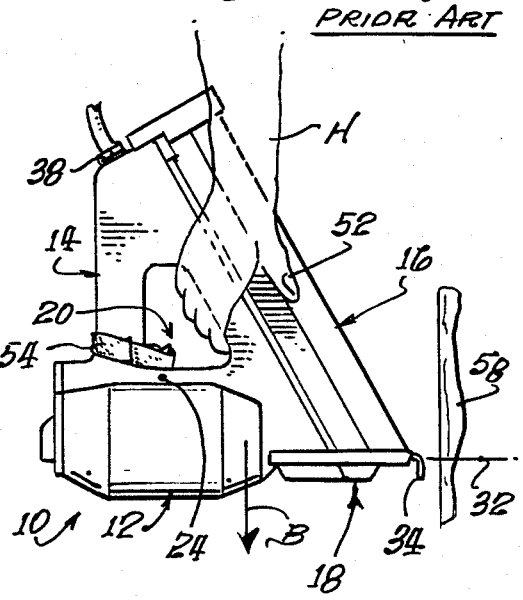
FIG. 5.
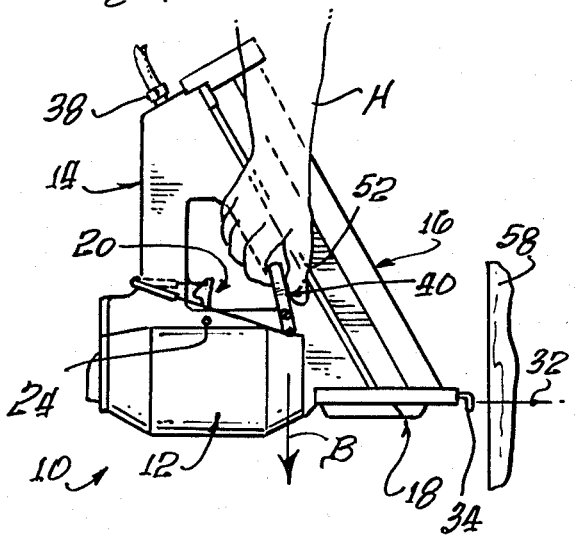
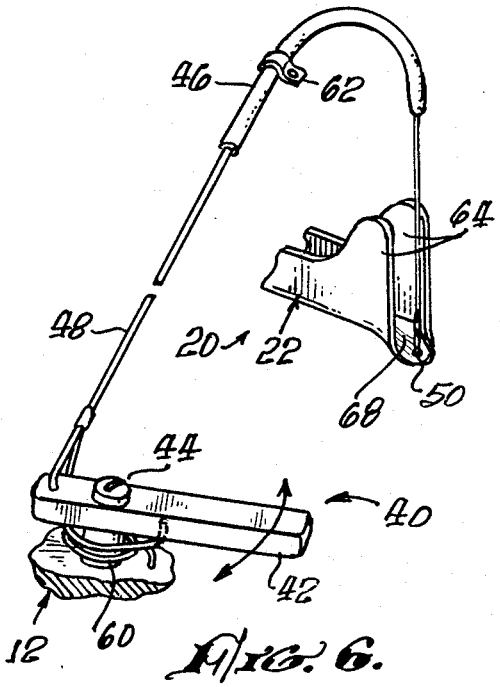
FIG. 6.

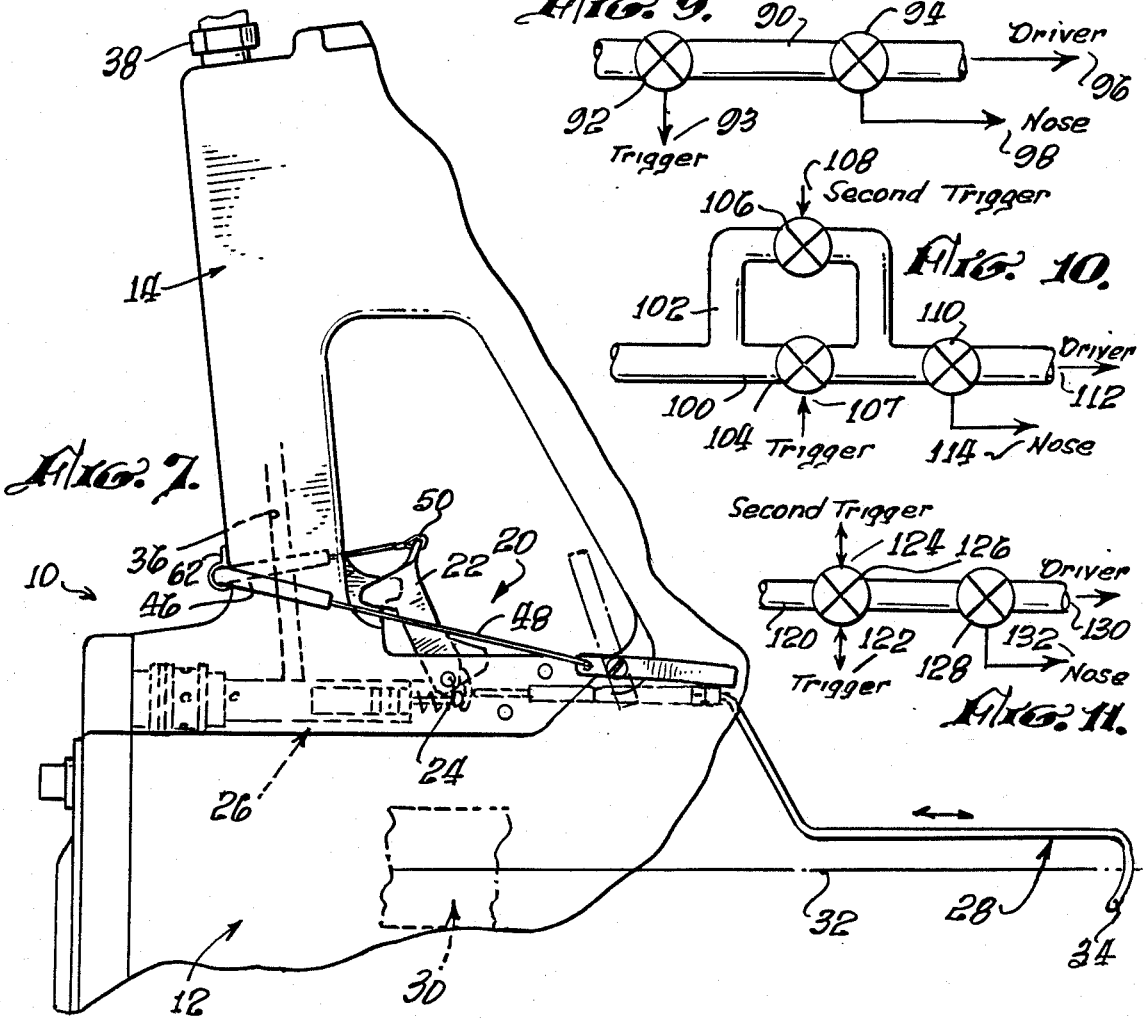
FIG. 7.
FIG. 9.
FIG. 10.
FIG. 11.
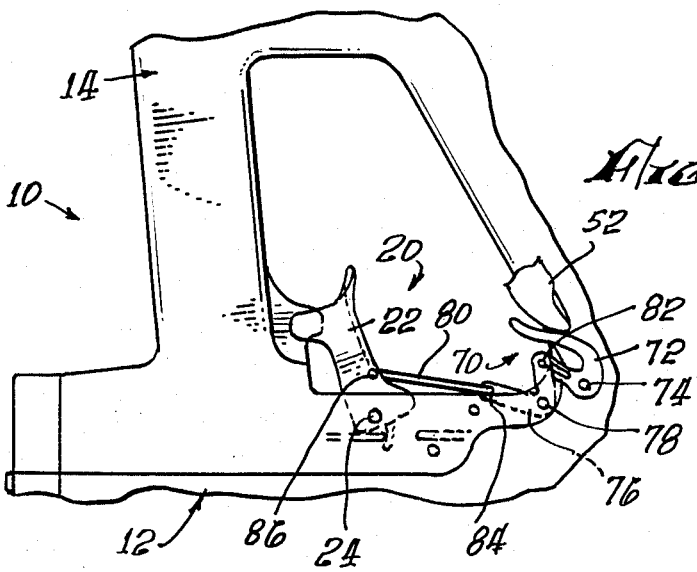
FIG. 8.

METHOD AND APPARATUS FOR AUXILIARY USE OF NAILING GUN

CROSS REFERENCE OF RELATED PATENT APPLICATIONS

There are no patent applications filed by me, related to this application.

THE BACKGROUND OF THE INVENTION

1. FIELD OF THE INVENTION

This invention is in the general field of apparatus and methods for use of such apparatus for the power driving of nails during construction and the like. The invention is more particularly related to a method and apparatus for practicing the method, wherein, nailing guns designed for vertical nailing alone can be easily converted to safe and tireless operation in horizontal nailing, while still complying with all safety regulations. The invention even more particularly relates to the method, wherein, an auxiliary safety trigger is operable from a position at a distance from the normal safety trigger, in order to facilitate the use for horizontal nailing.

2. DESCRIPTION OF THE PRIOR ART

There is essentially no prior art as to this invention. Nailing guns, for vertical nailing, such as flooring and the like are well-known, and in wide use. However, because of the balance of such guns, and the necessity of depressing a safety trigger for use of such guns, and because of the configuration of the gun, and the weight of the gun, is such that a man, cannot properly handle the gun for horizontal nailing, the only method heretofore used by which the gun may be handled effectively for horizontal nailing, such as framing and the like, has been to tape, or otherwise, permanetly hold the safety trigger in the active position, while doing the horizontal nailing. This cannot be considered prior art since the present invention deals with a method and apparatus for using an auxiliary safety switch or trigger, so that safety precautions are always observed.

SUMMARY OF THE INVENTION

In the construction industry, and in certain other industries, the use of pneumatic nailing guns is wide spread. There are many models on the market, by many manufacturers. Some of the guns are for nailing plain nails and some are for staples or specialized nails of one type or another.

All of the guns so far designed for commercial use have been so designed that they may be easily handled by one hand for vertical nailing. The balance is such that the operator holds the handle with his finger positioned on a safety trigger, which must be depressed, in order for the gun to be ready to nail. The nail then is actually activated by the pneumatic power, by touching the item to be nailed, with an activating member adjacent the position from which the nail is expelled.

In essence, the operation provides for driving the nail, by a pneumatically activated driver, and there are two switches in the airline supplying the pressure to activate the driving member. One switch is activated by the member adjacent the driving member, and when so activated the air is allowed to pass through the line. The other switch is activated by a hand operated trigger in the handle of the gun. Both switches must be activated to open the two valves, in order to allow air to travel to the driving mechanism.

The reason for the dual switching arrangement is that if there was no safety trigger, anyone touching, by accident, or on purpose, the activating switch adjacent the nail expulsion position, could cause a serious injury. In fact, many serious injuries have occurred, where persons have used tape or the like to permanently place the safety trigger in the active position.

The main reason the tape is ever used for such purpose, is that the nailing guns are also very effective for frame nailing, as well as the vertical nailing for which they were designed. However, the weight and balance of the gun is such, that the average person cannot possibly hold the gun in position for horizontal power nailing, and at the same time be able to activate the safety trigger. Thus, some workmen have taped the trigger into the active position, and then they are able to handle the gun in the horizontal position. However, when such is accomplished, when the gun is not actually being used for nailing in its proper manner, persons have been badly injured by the accidental activation of the switch adjacent the nail expulsion position of the gun.

Not only is the practice of taping the safety trigger into the active position dangerous, it is specifically illegal.

I have studied this problem, and have now conceived and developed a method and an apparatus by which, the nailing gun, the type described, can be held conveniently, by any workman and yet the safety trigger activated by an auxiliary means, located adjacent the convenient the holding position of the gun. I have developed several different methods and apparatus to accomplish this same end, in some instances utilizing a direct auxiliary safety trigger, directly connected within the mechanism of the gun, and in other instances, a remotely activated trigger connected to the primary exterior trigger, for the same purpose.

It is an object of this invention, to provide a method and apparatus for the safe operation of vertical nailing machines in a horizontal posture.

Another object of this invention is to provide such a method and apparatus, as has been mentioned, wherein, any workman, may utilize the method and apparatus, safely, in conjunction with customary vertical nailing machines.

Another object of this invention, is to provide such a method and apparatus as heretofore described, which is economical in utilization.

The forgoing and other objects and advantages of this invention, will become apparent to those skilled in the art, upon reading the description of a preferred embodiment, which follows, in conjunction with a review of the appended drawings.

BRIEF DESCRIPTION OF THE DRAWINGS

FIG. 3 is a side elevation, on a reduced scale, showing a prior art method of having to hold a typical nailing gun in condition for accomplishing nailing into a vertical structure;

FIG. 4 is a view similar to FIG. 3 wherein the gun is being held while the safety trigger is mechanically detained in condition for preparing the gun for activation;

FIG. 5 is a view similar to FIGS. 3 and 4 showing an operator supporting a nailing gun for horizontal nailing while using the auxiliary switch mechanism of the invention;

FIG. 6 is an enlarged fragmentary perspective, partly in section, of the trigger activating mechanism of the invention;

FIG. 7 is an enlarged side elevation, fragmentarily showing the placement of the auxiliary triggering device of FIG. 5;

FIG. 8 is a view similar to FIG. 7, but showing an alternate embodiment of the invention;

FIG. 9 is a schematic presentation of a conventional method of actuating a nailing gun;

FIG. 10 is a view similar to FIG. 9 showing an alternate embodiment of a method for actuation of a nailing gun; and FIG. 11 is a schematic view similar to FIGS. 9 and 10 showing the preferred metod of actuating a nailing gun.

DESCRIPTION OF A PREFERRED EMBODIMENT

Figure 1:
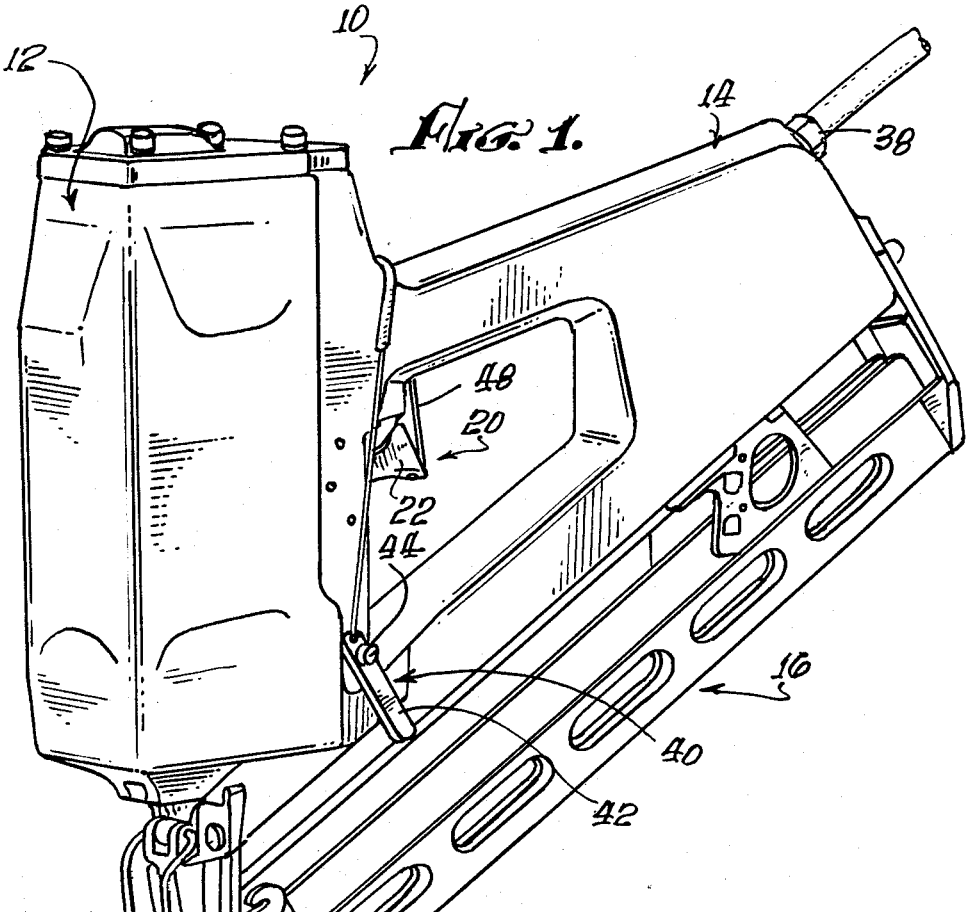
FIG. 1 is a perspective view of a nailing gun incorporating the present invention.
Figure 2:
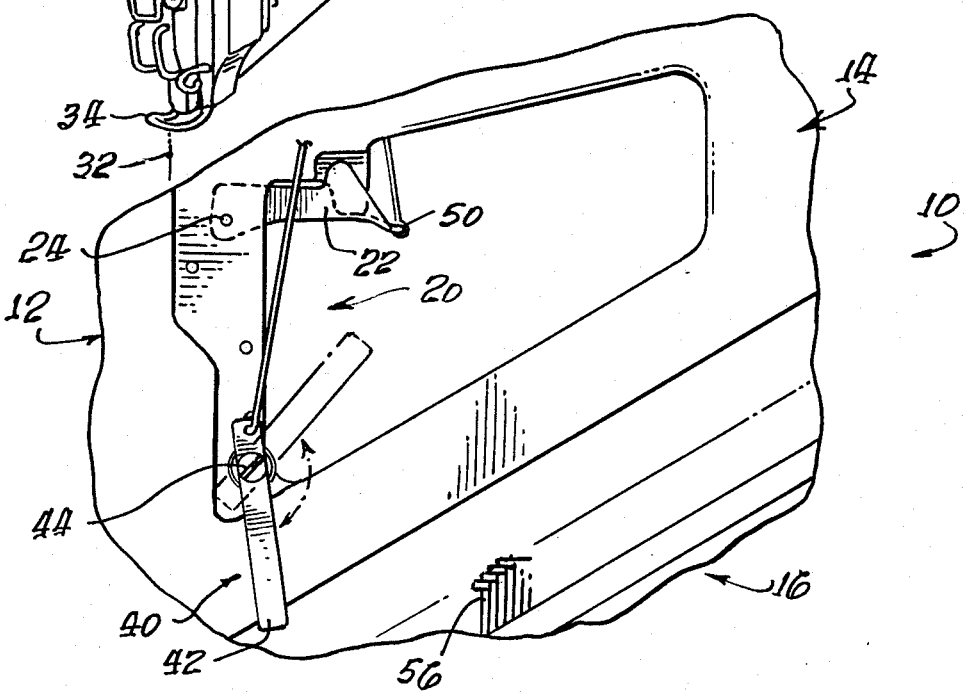
FIG. 2 is a fragmentary enlarged perspective of the device of FIG. 1 showing more fully the auxiliary activating switch of the invention.

The perspective view of FIG. 1 shows a typical, well-known, nailing gun which is used in the construction. The reference numeral 10 shows the gun, generally, and the actuation cylinder and piston housing 12, along with an attached handle portion 14. The nail, or staple, holding assembly 16 is shown being attached to the gun in order to feed such fastening devices into an actuating head area 18.

While I have shown such a gun that is well known in the art that can drive both nails, staples, and the like, from a supply mechanism, it is to be understood that such a gun can be of a type known in the industry and readily available for adaptation to the device of my invention.

A trigger mechanism is shown at 20 and is pressed by an operator of the gun by finger contact while gripping the handle and such trigger prepares the gun for ejection into a workpiece by an air-operated piston through another valve operation as will be described later in this application. The actual trigger 22 is shown pivotally mounted at 24 to the housing 12 and is placed in such a manner so as to actuate a valve 26 to allow air to be brought into position to actuate the nail ejection cylinder mechanism. The cylinder and piston mechanism at 30 ejects the nail along an axis 32. The feeler tip 34 allows the air to cause the nail ejection when it is touched against the workpiece.

Compressed air enters the handle of the gun assembly through the fitting 38 and passes through passage 36 into the area of the valve 26.

An auxiliary trigger actuating assembly is shown at 40 consists of a lever, or small handle, 42 is pivotally mounted at 44 to the housing and moves through a guide tube 46 a connecting line 48. This line may be made of nylon, or the like, or can be constructed of a flexible wire or cable. The movement of the lever 42 pulls the cable 48 through the guide tube 46 and moves the trigger 22 into an actuating condition in a remotely controlled manner.

While the gun is held by an operator's hand H, the thumb 52 rotates the lever to release the air into the area of the valve 26. Thus, it can be seen that the operator can simultaneously actuate the trigger as desired while the gun is being held in the position shown for horizontal nailing. Ordinarily, the actuation of the trigger has been a difficult task for an operator wanting to accomplish horizontal nailing, and the illustration of FIG. 3 shows this problem. In order to rectify the difficulty, the operator frequently tapes the trigger into an actuating condition permamently, as is shown in FIG. 4, and is then able to press the gun against a workpiece while holding the gun in a most comfortable position.

However, such a procedure is illegal, and very dangerous. While the trigger is taped in such a manner as is shown at 54, the the gun is considered "live" and any minute contact with the feeler 34 sets of the nailing procedure. Often serious accidents have taken place with this situation in effect.

The nails 56 are shown in a feeding reservoir and are finally ejected into the vertical post 58. It is to be understood that the gun can still be effectively used in nailing vertically when desired without infringement on the equipment shown at 40. A return spring 60 always brings the handle back into inoperative position when the thumb is taken away from it. A fastening tab 62 aids in keeping the guide tube 46 from moving around in its position about the handle. The ears 64 of the trigger are shown interconnected by a portion 66. The cable, or line, is shown to be attached to the trigger at 50 to effect the movement of the trigger into or out of contact for actuating the valve assembly.

FIG. 8 illustrates an alternate embodiment of the invention in which the assembly 70 of the remote trigger actuating assembly moves a lever 72 about pivot point 74 when actuated by an operator. A link 76 is shown pivotally mounted at 78 and moves connector element 80 to the trigger. Pivotal connections at 82 and 84 are shown mounted to the housing. The attachment point 86 moves the trigger into contacting the valve for preparing the gun for proper ejection procedures.

The schematic showing in FIG. 9 illustrates the air line 90 as allowing air under pressure to become available to pass through valve 92 after actuation of trigger 93 and to later pass through valve 94. This valve 94 is ordinarily activated when the nose 98 of the gun is touched, thereby allowing air to complete the nailing process through driver 96.

The showing in FIG. 10 shows an alternate embodiment of a method of actuating, remotely, the driver. The air line 100 is shown as being brought to valve 104 and simultaneously through line 102 to second triggered valve 106 by a second trigger 108. The first, and initial trigger found ordinarily in the gun assembly, is shown at 107. When the valve 110 is opened because of nose 114 being touched, then the driver 112 ejects the fastener into the workpiece. The second trigger is shown here schematically to illustrate that such a method can be easily adapted to a gun utilizing my principle.

The schematic showing in FIG. 11 is the method shown in FIGS. 1, 2, 5, 6, and 7 of the drawings. The line 120 of air under pressure is actuated by first and second trigger mechanisms 122 and 124 corresponding to the triggers 20 and 40 as previously described. The valve 126 then allows compressed air to come to the valve 128 which is actuated by contact to nose 132. This then allows the driver to do its work at 130.

The holding of the nailing gun, as shown in FIG. 3, is the method that is being used by operators without the aid of the present invention. While in this condition, the thumb 52 of the operator has to press the trigger mechanism 22, support the gun weight, and then try to align the nail on axis 32 to be driven into post 58. It can be seen that the weight of the gun and accessories are pulling along arrow A and making the chore of nailing for any lengthy period of time a tiring situation.

While the holding of the gun in FIG. 4 accomplishes the proper weight distribution of the gun, the illegal taping of the trigger makes this approach impractical.

Meanwhile, the showing in FIG. 5 illustrates the proper supporting of the tool, while being able to remotely actuate the trigger in a proper manner. The center of gravity at B is properly pulling down, and the operator can easily align the nail head along axis 32 to penetrate the workpiece 58.

The use of my invention is unique in that it can be attached to any conventional nailing gun with a minimum of cost and difficulty. It also makes the gun safe, and eliminates weariness during operation. This allows the operator to become more efficient and more productive.

While I have shown embodiments of this invention and have described the methods that are fully capable of achieving the objects and advantages desired, it is to be understood that such embodiments are for the purpose of illustration only and not for the purpose of limitation.

I claim:

1. The combination, with a pneumatic nailing gun, having a primary activating switch adjacent the area from which the nail is expelled, and a safety switch located adjacent the handle, of said nailing gun for use in vertical nailing, an auxiliary safety switch, located at a distance from the primary safety switch, which auxiliary safety switch is so positioned that it can be handled by a person for use in horizontal nailing.

2. The combination of claim 1, wherein, the auxiliary safety switch is directly interconnected to the primary safety switch, by connecting means.

3. The apparatus of claim 1, wherein, the auxiliary safety switch and the primary safety switch, are independently connected to an air valve controlling the activation of a driving member, in connection with the further activation of the switch adjacent the position from which the nail is expelled.

4. The combination of claim 1, wherein said safety switch activates a primary safety valve, and said auxiliary safety switch activates an auxiliary safety valve, bypassing said primary safety valve.

5. The combination of claim 1, wherein, said auxiliary switch is provided with independently activated means for maintaining said switch in inactive position, until said independently activated manes is independently moved.

* * * * *